US009416666B2

(12) United States Patent
Boyer

(10) Patent No.: US 9,416,666 B2
(45) Date of Patent: Aug. 16, 2016

(54) TURBINE BLADE PLATFORM COOLING SYSTEMS

(75) Inventor: Bradley Taylor Boyer, Greenville, SC (US)

(73) Assignee: General Electric Company, Schenectady, NY (US)

( * ) Notice: Subject to any disclaimer, the term of this patent is extended or adjusted under 35 U.S.C. 154(b) by 952 days.

(21) Appl. No.: 12/878,075

(22) Filed: Sep. 9, 2010

(65) Prior Publication Data

US 2012/0063916 A1 Mar. 15, 2012

(51) Int. Cl.
*F01D 5/14* (2006.01)
*F01D 5/18* (2006.01)

(52) U.S. Cl.
CPC ..... *F01D 5/187* (2013.01); *F05D 2240/305* (2013.01); *F05D 2240/306* (2013.01); *F05D 2240/81* (2013.01); *F05D 2260/2212* (2013.01); *F05D 2260/60* (2013.01)

(58) Field of Classification Search
CPC ..... F01D 5/147; F01D 5/18; F01D 25/12; F05D 2240/81; F05D 2260/205
USPC ..... 416/1, 90 R, 95, 97 R; 415/115, 116
See application file for complete search history.

(56) References Cited

U.S. PATENT DOCUMENTS

| | | | |
|---|---|---|---|
| 4,017,213 | A | 4/1977 | Przirembel |
| 5,340,278 | A | 8/1994 | Mogowan |
| 5,382,135 | A | 1/1995 | Green |
| 5,639,216 | A | 6/1997 | McLauin et al. |
| 5,813,835 | A | 9/1998 | Corsmeier et al. |
| 5,848,876 | A | 12/1998 | Tomita |
| 5,915,923 | A | 6/1999 | Tomita et al. |
| 6,017,189 | A | 1/2000 | Judet et al. |
| 6,019,579 | A | 2/2000 | Fukuno et al. |
| 6,065,931 | A | 5/2000 | Suenaga et al. |
| 6,071,075 | A | 6/2000 | Tomita et al. |
| 6,079,946 | A | 6/2000 | Suenaga et al. |
| 6,092,991 | A | 7/2000 | Tomita et al. |
| 6,120,249 | A | 9/2000 | Hultgren et al. |
| 6,132,173 | A | 10/2000 | Tomita et al. |

(Continued)

FOREIGN PATENT DOCUMENTS

| | | | |
|---|---|---|---|
| CN | 1162345 | A | 10/1997 |
| CN | 1611748 | A | 5/2005 |

(Continued)

OTHER PUBLICATIONS

Unofficial English translation of Office Action issued in connection with corresponding CN Application No. 201110283643.8 on Aug. 5, 2014.

(Continued)

*Primary Examiner* — Sean J Younger
(74) *Attorney, Agent, or Firm* — Sutherland Asbill & Brennan LLP

(57) ABSTRACT

The present application provides a turbine blade cooling system. The turbine blade cooling system may include a first turbine blade with a first turbine blade platform having a cooling cavity in communication with a pressure side passage and a second turbine blade with a second turbine blade platform having a platform cooling cavity with a suction side passage. The pressure side passage of the first turbine blade platform is in communication with the suction side passage of the second turbine blade platform.

20 Claims, 3 Drawing Sheets

(56) References Cited

U.S. PATENT DOCUMENTS

| | | | |
|---|---|---|---|
| 6,190,130 | B1 | 2/2001 | Fukue et al. |
| 6,196,799 | B1 | 3/2001 | Fukue et al. |
| 6,309,175 | B1 | 10/2001 | Hahnle et al. |
| 6,390,774 | B1 | 5/2002 | Lewis et al. |
| 6,402,471 | B1 | 6/2002 | Demers et al. |
| 6,416,284 | B1 | 7/2002 | Demers et al. |
| 6,431,833 | B2 | 8/2002 | Jones |
| 6,478,540 | B2 | 11/2002 | Abuaf et al. |
| 6,481,967 | B2 | 11/2002 | Tomita et al. |
| 6,572,335 | B2 | 6/2003 | Kuwabara et al. |
| 6,644,920 | B2 | 11/2003 | Beeck et al. |
| 6,945,749 | B2 | 9/2005 | Cardenas |
| 7,097,424 | B2 | 8/2006 | Cunha et al. |
| 7,131,817 | B2 | 11/2006 | Keith et al. |
| 7,144,215 | B2 | 12/2006 | Keith et al. |
| 7,147,439 | B2 | 12/2006 | Jacala et al. |
| 7,147,440 | B2 | 12/2006 | Benjamin et al. |
| 7,198,467 | B2 | 4/2007 | Keith et al. |
| 7,255,536 | B2 | 8/2007 | Cunha et al. |
| 7,309,212 | B2 | 12/2007 | Itzel et al. |
| 7,416,391 | B2 | 8/2008 | Veltre et al. |
| 2005/0095128 | A1 | 5/2005 | Benjamin et al. |
| 2005/0111980 | A1 | 5/2005 | Negulescu et al. |
| 2006/0056968 | A1 | 3/2006 | Jacala et al. |
| 2006/0269409 | A1 | 11/2006 | Torii et al. |
| 2007/0140848 | A1 | 6/2007 | Charbonneau et al. |
| 2007/0189896 | A1 | 8/2007 | Itzel et al. |
| 2009/0016881 | A1 | 1/2009 | Baldauf et al. |
| 2009/0202339 | A1 | 8/2009 | Torii et al. |

FOREIGN PATENT DOCUMENTS

| | | | |
|---|---|---|---|
| CN | 1869409 | A | 11/2006 |
| CN | 1910344 | A | 2/2007 |
| CN | 101473107 | A | 7/2009 |
| JP | 11236805 | A | 8/1999 |
| JP | 11257007 | A | 9/1999 |
| JP | 2001254605 | A | 9/2001 |
| JP | 2005146858 | A | 6/2005 |

OTHER PUBLICATIONS

Unofficial English Translation of Japanese Office Action issued in connection with corresponding JP Application No. 2011192215 on Jul. 21, 2015.

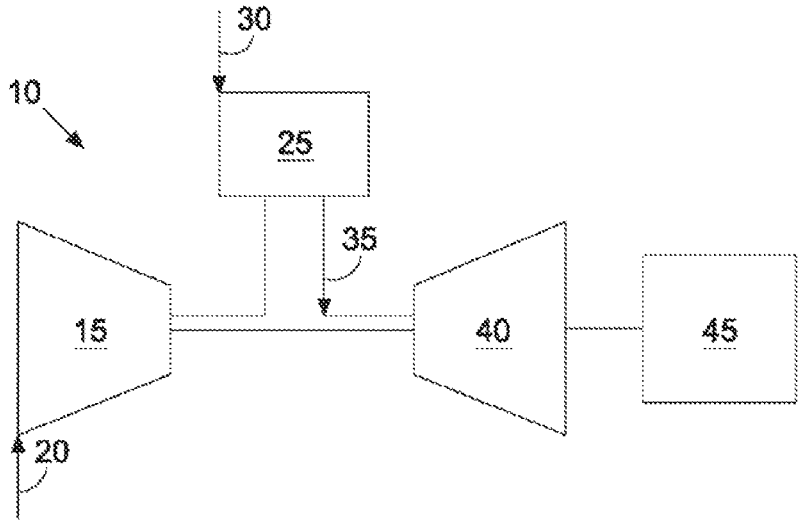
FIG. 1 *Prior Art*
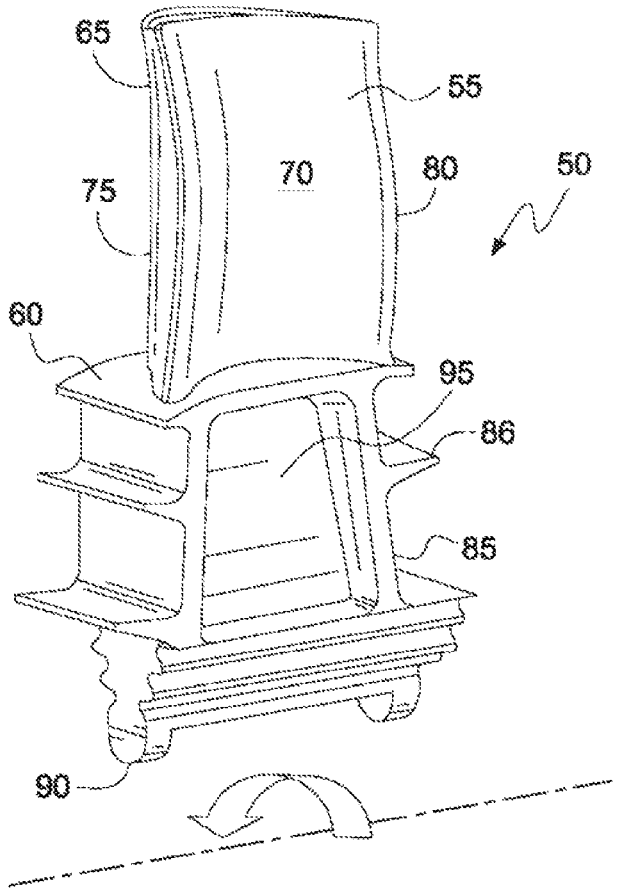
FIG. 2 *Prior Art*

TURBINE BLADE PLATFORM COOLING SYSTEMS

TECHNICAL FIELD

The present application relates generally to gas turbine engines and more particularly relates to turbine blade platform cooling systems so as to cool the suction side of adjacent blade platforms.

BACKGROUND OF THE INVENTION

Known turbine assemblies generally include rows of circumferentially spaced turbine blades. Generally described, each turbine blade includes an airfoil extending outwardly from a platform and a shank with a dovetail extending inwardly therefrom. The dovetail is used to mount the turbine blade to a rotor disc for rotation therewith. Known turbine blades generally are hollow such that an internal cooling cavity may be defined through at least portions of the airfoil, the platform, the shank, and the dovetail.

Temperature mismatches may develop at the interface between the airfoil and the platform and/or between the shank and the platform because the airfoil portions of the blades are exposed to higher temperatures than the shank and the dovetail portions. Over time, such temperature differences and associated thermal strains may induce large compressive thermal stresses to the blade platform. Moreover, the increased operating temperatures of the turbine as a whole may cause oxidation, fatigue, cracking, and/or creep deflection and, hence, a shorten useful life for the turbine blade. The potential stresses to the overall turbine blade and the bucket platform in particular generally increase with higher turbine combustion temperatures.

There is thus a desire for a turbine blade with improved cooling, particularly about the suction side of the platform. Such an improved turbine blade design would allow for the use of higher combustion temperatures and, hence, higher overall system efficiency with increased component lifetime.

SUMMARY OF THE INVENTION

The present application thus provides a turbine blade cooling system. The turbine blade cooling system may include a first turbine blade with a first turbine blade platform having a cooling cavity in communication with a pressure side passage and a second turbine blade with a second turbine blade platform having a platform cooling cavity with a suction side passage. The pressure side passage of the first turbine blade platform is in communication with the suction side passage of the second turbine blade platform.

The present application further provides a method of cooling a turbine blade platform. The method may include the steps of flowing a cooling medium through a pressure side passage of a first turbine blade platform, flowing the cooling medium through a suction side passage of a second turbine blade platform, flowing the cooling medium through a platform cooling cavity in the second turbine blade platform, and cooling the second turbine blade platform.

The present application further provides a turbine blade platform. The turbine blade platform may include a pressure side passage, a cooling circuit in communication with the pressure side passage, a suction side passage, and a platform cooling cavity in communication with the suction side passage.

These and other features and improvements of the present application will become apparent to one of ordinary skill in the art upon review of the following detailed description when taken in conjunction with the several drawings and the appended claims.

BRIEF DESCRIPTION OF THE DRAWINGS

FIG. 1 is a schematic view of the components of a known gas turbine engine.

FIG. 2 is a perspective view of a known turbine blade.

DETAILED DESCRIPTION

Figure 3:
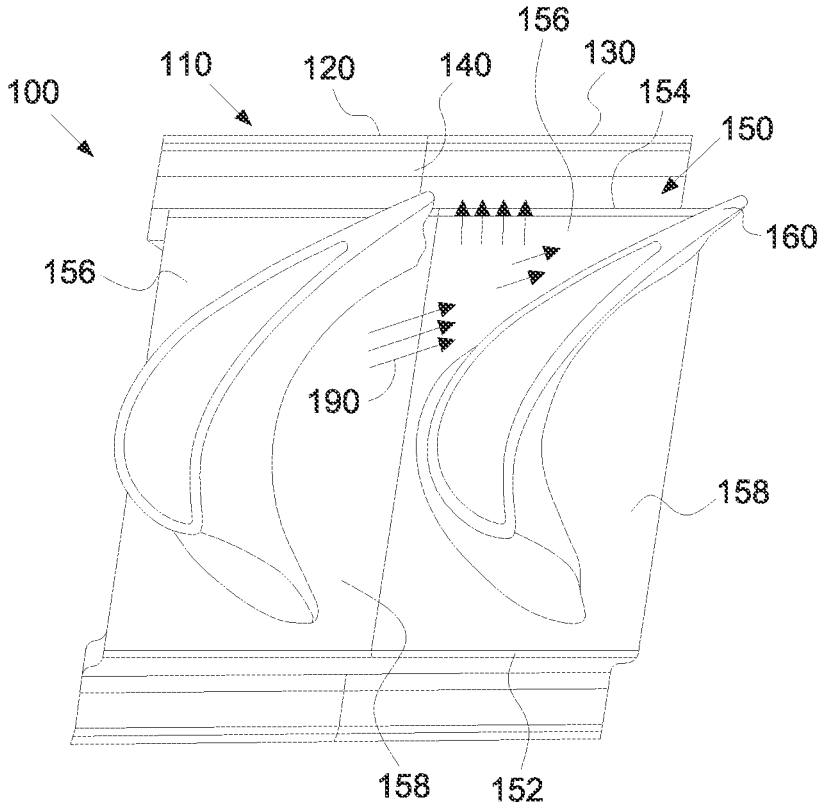
FIG. 3 is a top plan view of a pair of turbine blades of the turbine blade platform cooling system as may be described herein.

Referring now to the drawings, in which like numerals refer to like elements throughout the several views, FIG. 1 shows a schematic view of the components of a known gas turbine engine 10. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a compressed flow of fuel 30 and ignites the mixture to create a flow of combustion gases 35. Although only a single combustor 25 is shown, the gas turbine engine 10 may include any number of combustors 25. The flow of combustion gases 35 are in turn delivered to a turbine 40. The flow of combustion gases 35 drives the turbine 40 so as to produce mechanical work. The mechanical work produced in the turbine 40 drives the compressor 15 and an external load 45 such as an electrical generator and the like.

The gas turbine engine 10 may use natural gas, various types of syngas, and other types of fuels. The gas turbine engine 20 may be one of any number of different gas turbines offered by General Electric Company of Schenectady, N.Y. or otherwise. The gas turbine engine 10 may have other configuration and may use other types of components. Other types of gas turbine engines also may be used herein. Multiple gas turbine engines 10, other types of turbines, and other types of power generation equipment may be used herein together.

FIG. 2 shows a perspective view of a known turbine blade 50. The turbine blade 50 may be used in the turbine 40 as described above and the like. Any number of the blades 50 may be arranged adjacent to each other in a circumferentially spaced array. Each turbine blade 50 generally includes an airfoil 55 extending from a platform 60. The airfoil 55 may be convex in shape with a suction side 65 and a pressure side 70. Each airfoil 55 also may have a leading edge 75 and a trailing edge 80. Other airfoil configurations also may be used herein.

The turbine blade 50 also may include a shank 85 and a dovetail 90 extending inwardly from the platform 60. A number of angel wings 86 may be attached to the shank 85. The dovetail 90 may attach the turbine blade 50 to a disc (not shown) for rotation therewith. The shank 85 may be substantially hollow with a shank cavity 95 therein. The shank cavity 95 may be in communication with a cooling medium such compressor discharge air. Other types of cooling circuits and cooling mediums also may be used herein. The cooling medium may circulate through at least portions of the dovetail 90, the shank 85, the platform 60, and into the airfoil 55. Other configurations may be used herein.

Figure 4:
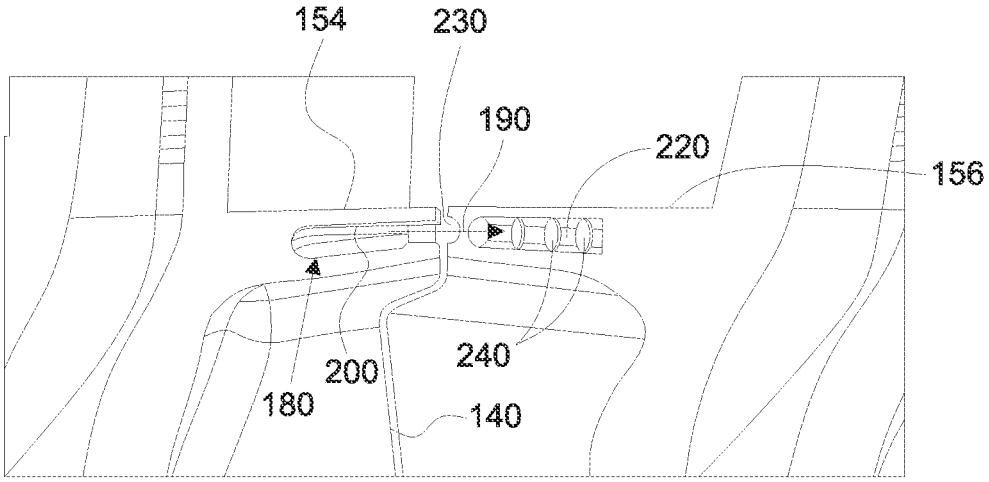
FIG. 4 is a side cross-sectional view of the pair of turbine blades of the turbine blade platform cooling system of FIG. 3.
Figure 5:
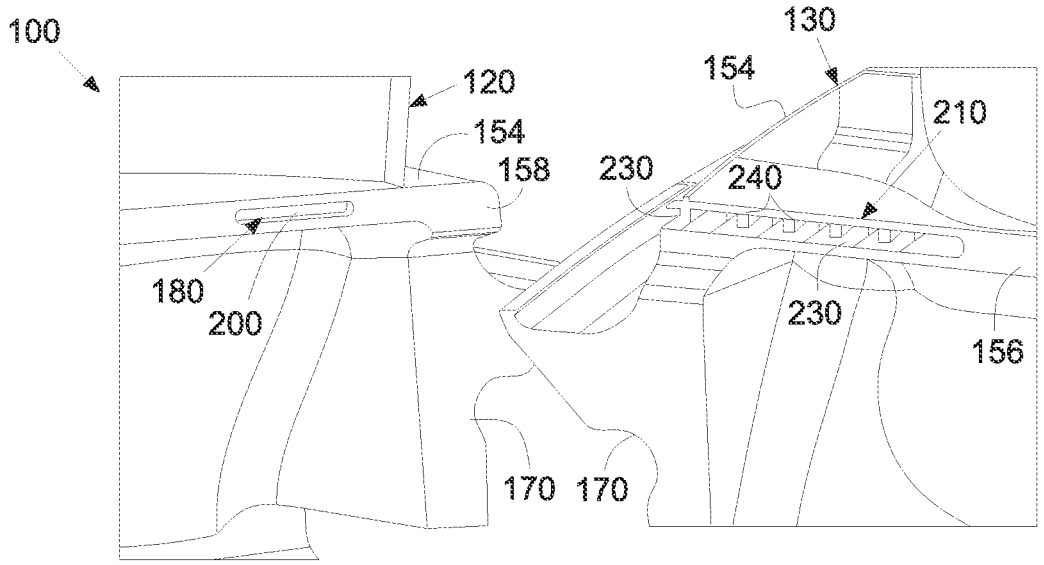
FIG. 5 is a partial side perspective view of the pair of turbine blades of the turbine blade platform cooling system of FIG. 3 as separated.

FIGS. 3-5 show a turbine blade platform cooling system 100 as may be described herein. The turbine blade platform cooling system 100 may include any number of turbine blades 110 although only a first turbine blade 120 and a second turbine blade 130 are shown. As described above, any number of the turbine blades 110 may be circumferentially positioned adjacent to each other about a rotor disc (not shown). Each pair of the turbine blades 110 may define a gap 140 therebetween. The first turbine blade 120 and the second turbine blade 130 may be substantially identical.

Each turbine blade 110 may include a platform 150 with an airfoil 160 extending outwardly therefrom and a shank 170 extending inwardly therefrom. The platform 150 may have a forward side 152, an aft side 154, a suction side 156, and a pressure side 158.

The turbine blade 110 may include a cooling cavity 180 extending therethrough. The cooling cavity 180 may be in communication with a cooling medium 190 such as compressor discharge air and the like. The cooling cavity 180 may extend at least in part through the shank 170 and into the airfoil 160. A portion of the cooling cavity 180 also may extend into the platform 150 such that at least a portion of the cooling medium 190 may pass therethrough, either instead of or after passing through the airfoil 160. Specifically, the cooling cavity 180 may extend into the aft portion 154 of the platform 150 about the pressure side 158 thereof. The portion of the cooling cavity 180 may end about a pressure side passage 200 of the platform 150. Other configurations may be used herein.

The platform 150 also may include a platform cooling cavity 210. The platform cooling cavity 210 may extend from the suction side 156 of the platform 150 towards the aft side 154. The platform cooling cavity 210 may begin about a suction side passage 220. The suction side passage 220 may align with the pressure side passage 200 of the adjoining turbine blade 110 so as to pass the cooling medium 190 therethrough. The platform cooling cavity 210 also may include an aft side passage 230 so as to discharge the cooling medium 190 once it passes therethrough. The platform cooling cavity 210 also may include a pin bank or other types of turbulators 240 therein so as to provide turbulence for enhanced heat transfer. Other types of internal configurations may be used herein.

In use, the cooling medium 190 passes through the cooling channel 180 of the first turbine blade 120. At least a portion of the cooling medium 190 passes through the platform 150 and exits via the pressure side passage 200. The cooling medium 190 then passes through the gap 140 and into the platform cooling cavity 210 of the second turbine blade 130. Specifically, the cooling medium 190 passes into the suction side passage 220 of the platform cooling cavity 210 positioned on the suction side 156 of the platform 150 along the aft end 154 thereof. The cooling medium 190 then may exit the platform 150 along the aft side passage 230.

The turbine blade platform cooling system 100 thus provides cooling on the suction side 156 of the platform 150 of the second turbine blade 130 via the cooling medium 190 from the first turbine blade 120. The pin bank or other types of turbulators 240 within the platform cooling cavity 210 also provide enhanced heat transfer therein. This cooling also provides some lateral flexibility between the cooler shank side and the hot gas side of the platform 150 so as to reduce thermal stresses therein. Surface film holes and the like also may be used herein in communication with the platform cooling cavity 210. Various types of seals also may be used about the gap 140 to reduce leakage and ingestion therethrough.

The turbine blade platform cooling system 100 thus provides platform cooling to enable higher turbine operating temperatures so as to provide higher efficiencies and lower customer operating costs with less impact on component durability. Using the cooling medium 190 from the first blade 120 so as to cool the second blade 130 further increases such overall efficiency. Transfer of the cooling medium 190 also may be made from the suction side 156 to the pressure side 158 in a similar manner. Any type of platform to platform cooling schemes in any direction may be used herein.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

I claim:

1. A turbine blade cooling system, comprising:

a first turbine blade;

the first turbine blade comprising an airfoil, a first turbine blade platform, and a blade cooling cavity extending into the airfoil and the first turbine blade platform;

wherein the blade cooling cavity is in communication with a pressure side passage positioned in the first turbine blade platform and extending to a pressure side edge of the first turbine blade platform, wherein the pressure side passage has a first axial length extending from a forward end to an aft end of the pressure side passage each positioned along the pressure side edge of the first turbine blade platform, wherein the airfoil has a second axial length extending from a forward end to an aft end of the airfoil, and wherein the aft end of the pressure side passage is positioned axially upstream with respect to the aft end of the airfoil; and a second turbine blade;

the second turbine blade comprising a second turbine blade platform and a platform cooling cavity;

wherein the platform cooling cavity is in communication with a suction side passage positioned in the second turbine blade platform and extending to a suction side edge of the second turbine blade platform; and wherein the pressure side passage of the first turbine blade platform is in communication with the suction side passage of the second turbine blade platform.

2. The turbine blade cooling system of claim 1, wherein the first turbine blade platform comprises a pressure side, and wherein the pressure side passage is positioned at least partially therein.

3. The turbine blade cooling system of claim 1, wherein the first turbine blade platform comprises an aft side, and wherein the pressure side passage is positioned at least partially therein.

4. The turbine blade cooling system of claim 1, wherein the second turbine blade platform comprises a suction side, and wherein the suction side passage is positioned at least partially therein.

5. The turbine blade cooling system of claim 1, wherein the second turbine blade platform comprises a suction side and an aft side, and wherein the platform cooling cavity is positioned at least partially in the suction side and at least partially in the aft side.

6. The turbine blade cooling system of claim 1, wherein the first axial length is less than the second axial length.

7. The turbine blade cooling system of claim 1, wherein the second turbine blade platform comprises an aft side, and wherein the platform cooling cavity is in communication with an aft side passage positioned at least partially therein.

8. The turbine blade cooling system of claim 1, further comprising a gap defined between the pressure side edge of the first turbine blade platform and the suction side edge of the second turbine blade platform.

9. The turbine blade cooling system of claim 1, wherein the forward end of the pressure side passage is positioned axially downstream with respect to the forward end of the airfoil.

10. The turbine blade cooling system of claim 1, wherein the second turbine blade further comprises a plurality of turbulators positioned in the platform cooling cavity.

11. A method of cooling a turbine blade platform, comprising:

flowing a cooling medium through a blade cooling cavity positioned in a first turbine blade, wherein the blade cooling cavity extends into an airfoil and a first turbine blade platform of the first turbine blade;

flowing the cooling medium through a pressure side passage positioned in the first turbine blade platform and extending to a pressure side edge of the first turbine blade platform, wherein the pressure side passage is in communication with the blade cooling cavity, wherein the pressure side passage has a first axial length extending from a forward end to an aft end of the pressure side passage each positioned along the pressure side edge of the first turbine blade platform, wherein the airfoil has a second axial length extending from a forward end to an aft end of the airfoil, and wherein the aft end of the pressure side passage is positioned axially upstream with respect to the aft end of the airfoil;

flowing the cooling medium through a suction side passage positioned in a second turbine blade platform of a second turbine blade and extending to a suction side edge of the second turbine blade platform, wherein the suction side passage of the second turbine blade platform is in communication with the pressure side passage of the first turbine blade platform;

flowing the cooling medium through a platform cooling cavity positioned in the second turbine blade platform, wherein the platform cooling cavity is in communication with the suction side passage; and cooling the second turbine blade platform.

12. The method of cooling a turbine blade platform of claim 11, wherein the step of flowing the cooling medium through the platform cooling cavity comprises creating turbulence therein.

13. The method of cooling a turbine blade platform of claim 11, further comprising the step of flowing the cooling medium out of the platform cooling cavity via an aft side passage positioned in the second turbine blade platform.

14. The method of cooling a turbine blade platform of claim 11, further comprising the step of sealing a gap defined between the pressure side edge of the first turbine blade platform and the suction side edge of the second turbine blade platform.

15. The method of cooling a turbine blade platform of claim 11, wherein the forward end of the pressure side passage is positioned axially downstream with respect to the forward end of the airfoil.

16. A turbine blade, comprising:

an airfoil;

a platform, comprising:

a pressure side passage extending to a pressure side edge of the platform;

a suction side passage extending to a suction side edge of the platform; and a platform cooling cavity in communication with the suction side passage; and a blade cooling cavity extending into the airfoil and the platform;

wherein the blade cooling cavity is in communication with the pressure side passage;

wherein the pressure side passage has a first axial length extending from a forward end to an aft end of the pressure side passage each positioned along the pressure side edge of the platform;

wherein the airfoil has a second axial length extending from a forward end to an aft end of the airfoil;

wherein the aft end of the pressure side passage is positioned axially upstream with respect to the aft end of the airfoil; and wherein the pressure side passage is configured to communicate with a second suction side passage of an adjacent second turbine blade.

17. The turbine blade of claim 16, wherein the platform comprises a suction side and an aft side, and wherein the platform cooling cavity is positioned at least partially in the suction side and at least partially in the aft side.

18. The turbine blade of claim 16, wherein the forward end of the pressure side passage is positioned axially downstream with respect to the forward end of the airfoil.

19. The turbine blade of claim 16, wherein the platform comprises an aft side, and wherein the platform cooling cavity is in communication with an aft side passage positioned at least partially therein.

20. The turbine blade of claim 16, further comprising a plurality of turbulators positioned in the platform cooling cavity.

* * * * *